United States Patent [19]

Toal

[11] 4,130,939

[45] Dec. 26, 1978

[54] WALL EDGE TRIMMERS FOR RESILIENT FLOOR COVERINGS

[75] Inventor: Hugh Toal, Kearny, N.J.

[73] Assignee: Congoleum Corporation, Kearny, N.J.

[21] Appl. No.: 823,819

[22] Filed: Aug. 11, 1977

[51] Int. Cl.[2] ..... B26B 29/00

[52] U.S. Cl. ..... 30/293; 30/294

[58] Field of Search ..... 30/294, 293, 289, 286, 30/287, 288

[56] References Cited

U.S. PATENT DOCUMENTS

| | | | |
|---|---|---|---|
| 2,607,115 | 8/1952 | Iovinelli | 30/293 |
| 3,395,453 | 8/1968 | Prater | 30/293 |
| 4,041,605 | 8/1977 | Selfridge | 30/293 |
| 4,043,038 | 8/1977 | Selfridge | 30/293 |

FOREIGN PATENT DOCUMENTS

| | | | |
|---|---|---|---|
| 566233 | 12/1944 | United Kingdom | 30/294 |
| 879804 | 10/1961 | United Kingdom | 30/293 |

*Primary Examiner*—James L. Jones, Jr.
*Assistant Examiner*—J. T. Zatarga
*Attorney, Agent, or Firm*—Richard T. Laughlin

[57] ABSTRACT

A wall edge trimmer for resilient floor coverings comprising: a relatively smooth base surface capable of sliding along the surface of a resilient floor covering laid out on a floor; a relatively smooth front surface lying in a plane substantially at right angles to the plane containing the base surface and capable of sliding along the surface of a portion of the resilient floor covering which is curled upwardly and contacts the lower portion of a wall; a relatively smooth arcuate surface in the form of a quarter cylinder connecting the base surface and the front surface; and a cutting tool on the wall edge trimmer having a cutting edge intersecting the arcuate surface and extending from a point within the wall edge trimmer to a point beyond the arcuate surface, the base surface contacting the arcuate surface at a direct, level, straight-line distance from the vertical plane containing the front surface equal to the arcuate distance from the point of the intersection of the base surface and the arcuate surface to the point of intersection of the arcuate surface and the cutting edge of the cutting tool, as measured along the arcuate surface.

4 Claims, 4 Drawing Figures

WALL EDGE TRIMMERS FOR RESILIENT FLOOR COVERINGS

THE FIELD OF THE INVENTION

The present invention relates to a wall edge trimmer for resilient floor coverings which enables persons with little or no experience to expertly and precisely cut and trim the edges of resilient floor coverings, so that they will butt in a very snug, wall-to-wall fashion against the walls of a room in which the resilient floor covering is being installed.

THE BACKGROUND OF THE INVENTION

In the installation of wall-to-wall resilient floor coverings, it is always very desirable that the cut and trimmed edges of the resilient floor coverings exactly and precisely abut the walls of the room without being cut too short to leave "white edges" or gaps between the resilient floor covering and the wall, or without being cut too long, whereby the surplus resilient floor covering is squeezed or compressed in the installation in order to make it lie flat, thereby increasing the possibility of unsightly bulges and ridges in the installed resilient floor covering.

THE PURPOSE AND OBJECT OF THE INVENTION

The principal purpose and object of the present invention is to take substantially all of the guesswork and the estimating out of such wall-to-wall installation procedures, whereby exact and precise wall-to-wall cuttings and fittings may be made by persons having little or no experience in such cutting and trimming installation procedures.

BRIEF SUMMARY OF THE INVENTION

It has been found that such purpose and object of the present invention, as well as other purposes and objects which will become clear from a further reading and understanding of this disclosure, may be accomplished by providing a wall edge trimmer for resilient floor coverings which comprises a relatively smooth base surface capable of sliding along the surface of a resilient floor covering laid out on a floor; a relatively smooth front surface lying in a plane substantially at right angles to the plane containing the base surface and capable of sliding along the surface of a portion of the resilient floor covering which is curled upwardly and contacts the lowermost portion of a wall; a relatively smooth arcuate surface in the form of a quarter cylinder connecting the base surface and the front surface; and a cutting tool on the wall edge trimmer having a cutting edge intersecting the arcuate surface and extending from a point within the wall edge trimmer to a point beyond the arcuate surface, the base surface contacting the arcuate surface at a direct, level, straight-line distance from the vertical plane containing the front surface, the straight-line distance being equal to the arcuate distance from the point of intersection of the arcuate surface and the base surface to the point of intersection of the arcuate surface and the cutting edge of the cutting tool, as measured along the arcuate surface.

BRIEF DESCRIPTION OF THE DRAWINGS

In the following specification and accompanying self-explanatory drawings, there are described and illustrated preferred and typical embodiments of the present invention but it is to be understood that the broader aspects of the present invention are not to be construed as limited to such specifically described and illustrated preferred and typical embodiments, except as defined and limited by the scope of the appended claims.

Referring to the accompanying self-explanatory drawings.

It is to be appreciated that some dimensions in the above-identified Figures are not always precisely or perfectly accurately drawn to scale and that some dimensions have been increased and others have been decreased, essentially only to more clearly illustrate the basic principles of the present invention and to more expeditiously render its understanding.

DESCRIPTION OF THE PREFERRED EMBODIMENTS OF THE INVENTION

Figure 1:
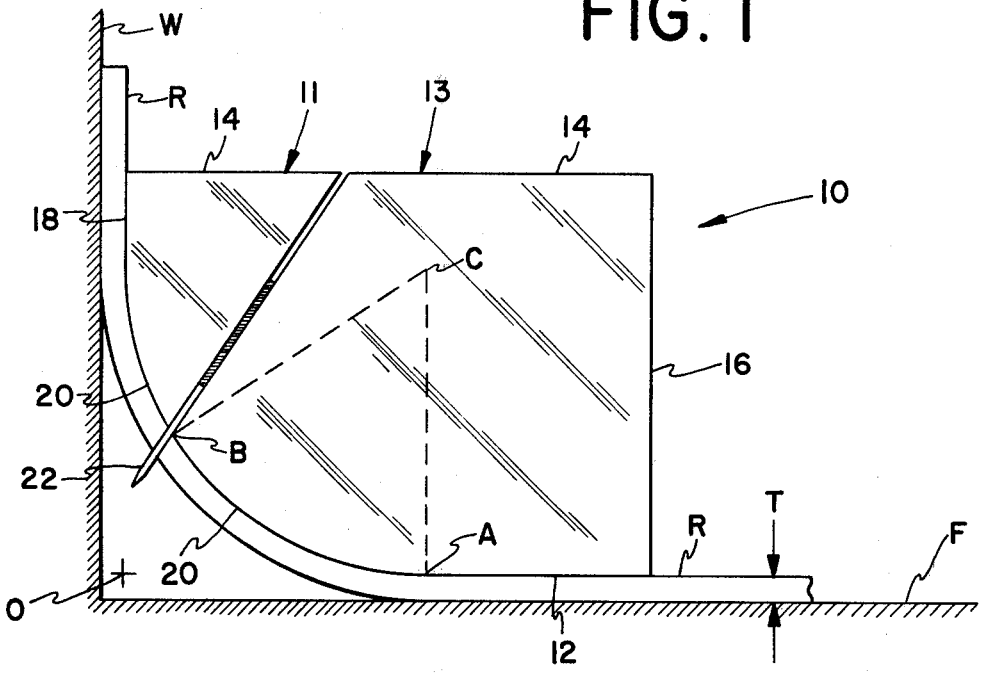
FIG. 1 is a simplified side view in elevation, illustrating the basic principles involved in a specific, preferred embodiment of the present invention in a very simple, basic form.
Figure 2:
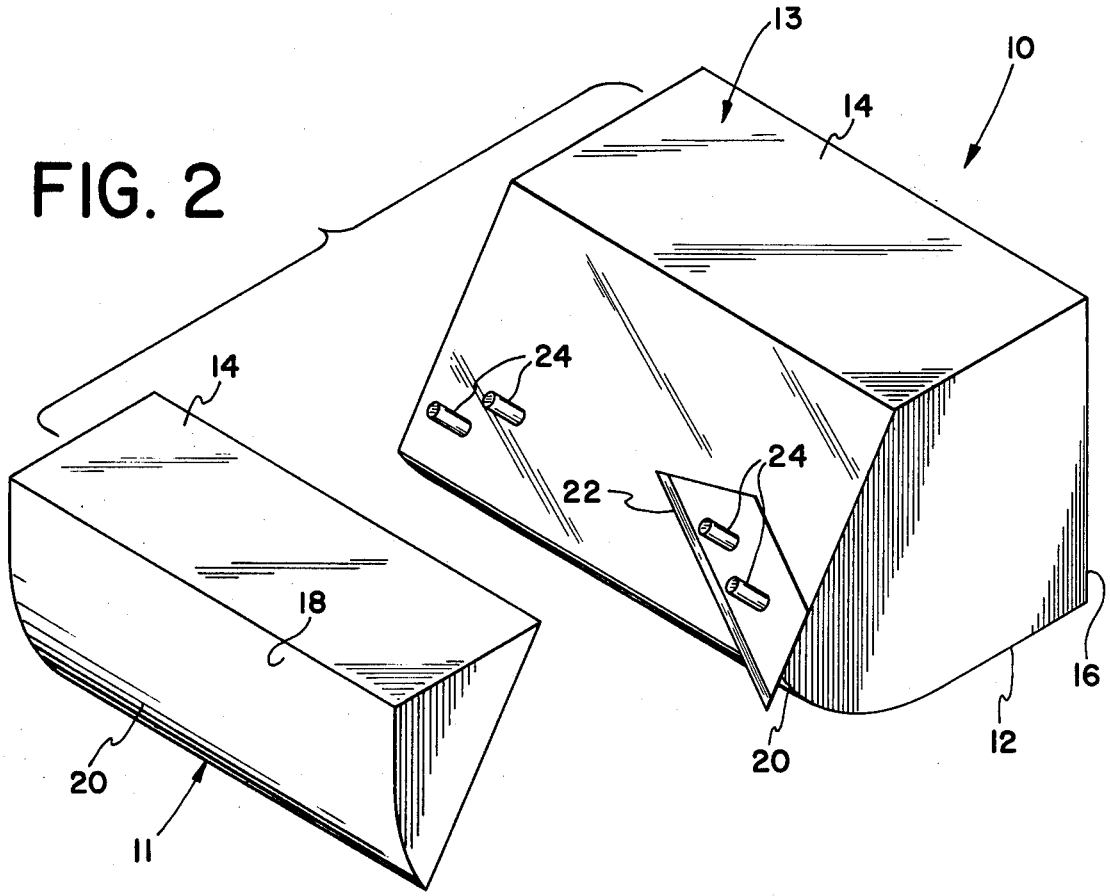
FIG. 2 is a simplified, exploded, perspective view which further illustrates the basic principles of the specific, preferred embodiment of FIG. 1.

In FIGS. 1 and 2, there is shown a wall edge trimmer 10 having a front part 11 and a rear part 13. The complete wall edge trimmer 10 comprises a flat, horizontally planar, relatively smooth base surface 12; an upper or top surface 14 which, in FIGS. 1 and 2, is shown as divided into two portions, one on front part 11 and the other on rear part 13; a rear surface 16; and a flat, vertically planar, relatively smooth front surface 18 which is in a plane substantially perpendicular or at right angles to the plane containing the base surface 12. A relatively smooth, curved or arcuate surface 20 is also provided and smoothly connects the horizontal base surface 12 and the vertical front surface 18. The curved or arcuate surface 20, as shown in FIGS. 1 and 2, is also divided into two curved or arcuate portions, one on front part 11 and the other on rear part 13.

The curved or arcuate surface 20 which extends between the horizontal base surface 12 and the vertical front surface 18 is the surface of a quarter of a right, regular cylinder which is formed by passing two planes at right angles to each other through the center or central axis C of the right, regular cylinder. The radius of such a right, regular cylinder is in the range of from about ½ inch to about 3 inches, depending upon the general nature, thickness, and flexibility of the resilient floor coverings which are normally used in the wall-to-wall installation procedures.

The base surface 12 possesses sufficient horizontal surface area and is sufficiently planar that it is capable of smoothly and easily sliding in a steady, stable, non-rocking fashion along the surface of a resilient floor covering R which is being laid or installed on a floor F or similar surface.

In FIG. 1, it is to be observed that the resilient floor covering R lays substantially flat upon the floor F with a relatively short portion thereof curled vertically upwardly against the lowermost portion of a vertical wall W. This configuration is, of course, in accordance with the initial steps of standard or conventional procedures for the installation of wall-to-wall resilient floor coverings and similar materials.

When the wall edge trimmer 10 is brought snugly against the resilient floor covering R, it is noted that its curved or arcuate surface 20 smoothly fits against and is capable of riding easily on the curved portion of the resilient floor covering R and that its front surface 18 presses the upwardly curled portion of the resilient floor covering R against the lowermost portion of the vertical wall W. The front surface 18 possesses sufficient vertical surface area and is also sufficiently planar and smooth that it can easily slide in a steady, stable, non-rocking fashion along the vertically extending portion of the resilient floor covering R.

As noted in FIGS. 1 and 2, the complete wall edge trimmer 10 can be separated into two parts 11 and 13 and a relatively thin cutting blade or tool 22 can be inserted therebetween in one of the two positions, as desired. The relatively thin cutting blade or tool 22 extends from within the inside of the body of the wall edge trimmer 10 and protrudes beyond the curved or arcuate surface 20 so that its sharp cutting edge will consequently pass through the curved or arcuate portion of the resilient floor covering R, when it is positioned as shown in FIG. 1. In bringing the wall edge trimmer 10 to the position shown in FIG. 1, such is accomplished by bringing the wall edge trimmer 10 to the left but with a downward direction so that the sharp cutting edge passes cleanly through the resilient floor covering R.

It is to be appreciated that, once the cutting edge of the cutting tool 22 has been passed through the resilient floor covering R, all that is required is for a person to smoothly and evenly slide the wall edge trimmer 10 along the lowermost portion of the wall W, keeping the vertically upwardly curled portion of the resilient floor covering R smoothly pressed against the lowermost portion of the wall W, whereby the cutting tool 22 cuts the resilient floor covering R in a long straight line adjacent and parallel to the wall W, after which the cut edge inclines downwardly and hopefully abuts the wall W perfectly and smoothly with no gaps, white edges, or surplus material. The locating of the point at which the cutting edge of the cutting tool passes through and cuts the resilient floor covering R is therefore critical for a successful wall-to-wall installation and is of the utmost importance. It is insufficient and undesirable that a person be compelled to estimate or to guess where that point of entry must be located, particularly if that person is not experienced in wall-to-wall installing of resilient floor coverings.

In order to take out or eliminate the guesswork and the estimating involved in the locating of the proper point of entry of the cutting edge of the cutting tool 22, it is essential that the base surface 12 meets or intersects with the curved or arcuate surface 20 at a point A having a direct, level, horizontal straight-line distance AO to the vertical plane containing the vertical front surface 18, which straight-line distance AO is equal to the arcuate distance AB from the point A to the point of intersection B of the curved or arcuate surface 20 and the cutting edge of the cutting tool 22, as measured along the curved or arcuate surface 20. And, further, that such straight-line distance AO and such arcuate distance AB be equal to a radian or the radius of the quarter cylinder which forms the curved or arcuate surface 20.

More briefly stated and in abstract geometric terms, straight-line distance AO must equal curved or arcuate distance AB, and both must equal one radian or the radius of the quarter cylinder forming the curved or arcuate surface 20.

AO equals AB equals 1 radian (the radius of the quarter cylinder).

If such distances are precisely measured and obtained, then the resilient floor covering R will be cut and trimmed precisely and accurately without any guesswork or estimating and the cut and trimmed edge of the resilient floor covering R will precisely and accurately come to rest in a horizontal configuration wherein it abuts perfectly against the very lowermost portion of the vertical wall W by simply using the wall edge trimmer 10.

Projecting positioning pegs or studs 24 may be provided on the front slanting part of the rear portion 13 (see FIG. 2) in order to properly position the cutting edge of the cutting tool 22 which, as shown, somewhat generally resembles a thin razor blade, which may be single-edge or double-edge. Such thin razor blades, or equivalent cutting tools, may have thicknesses of as little as 0.010 inch and for all intents and purposes, the thickness of such very thin cutting tools are a negligible factor in applying the principles of the present invention.

The protruding positioning pegs or studs 24 fit within holes in the cutting blade 22 and extend into holes or recessed openings (not shown) in the underside of the front part 11 of the wall edge trimmer 10, whereby the two parts 11 and 13 may be brought together in substantially contacting relationship, save for the thickness of the very thin cutting blade 22.

THE USE OF THE WALL EDGE TRIMMER

The assembled wall edge trimmer 10 is carefully brought into contact with the upwardly curled edge portion of the resilient floor covering R with a generally downward, inward movement to the left, as seen in FIG. 1, so that the cutting tool 22 cleanly penetrates and cuts through the resilient floor covering R. Once the wall edge trimmer 10 is properly positioned, as seen in FIG. 1, it is then moved parallel to the wall W in a forward cutting stroke, thus trimming the edge of the resilient floor covering R. At the end of the forward cutting stroke, the position of the cutting tool 22 may be reversed and a rearward cutting stroke taken in the reverse direction, as is done in conventional wall-to-wall installation procedures. Inasmuch as the cutting edge does not reach completely to the extreme ends of such forward or rearward cutting strokes, the very short uncut ends may be subsequently cut manually. This is standard operating procedure.

If the wall W departs gradually from a straight, vertical plane, as practically all walls do, the wall edge trimmer 10 will be correspondingly guided and will move outwardly to compensate for bulges, or inwardly to compensate for indentations, in a form of pattern-scribing procedure, whereby the trimmed edges of the resilient floor covering R even more closely are butted against the lowermost portion of the wall W. The wall edge trimmer 10 of FIGS. 1 and 2 is found to be excellent for use with resilient floor coverings of thicknesses of $\frac{1}{8}$ inch or less.

THE MODIFICATION OF FIG. 3

For heavier resilient floor coverings having greater thicknesses, say, up to ¼ inch or more, it is found desirable to increase the curved or arcuate distance AB accordingly. This can easily be done by the use of spacing means which will move the cutting blade 22 and its point of penetration B through the arcuate surface 20 upwardly and to the left, as seen in FIG. 3.

Figure 3:
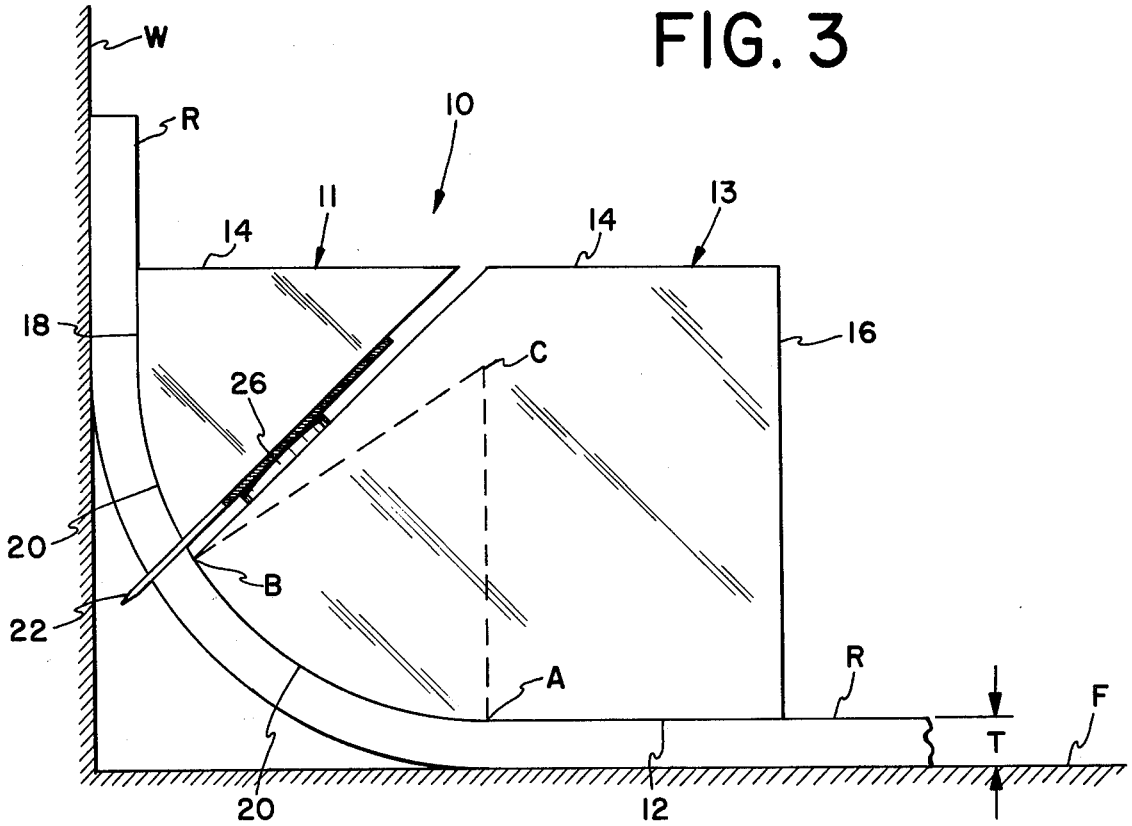
FIG. 3 is a simplified side view in elevation, illustrating the use of a modification of the specific, preferred embodiment of FIGS. 1 and 2, as applied to resilient floor coverings of greater thickness.

As seen in FIG. 3, spacers 26, or other spacing means, which may take the form of small annular washers of a predetermined thickness which fit over the ends of the protruding positioning pegs 24, may be provided in order that the two parts 11 and 13 may be brought together in differently spaced parallel relationship, as desired or required. Other spacing means may be provided in order to insure that the two parts 11 and 13 are properly spaced, whereby the effective arcuate distance from the point of intersection of the base surface 12 with the curved or arcuate surface 20 to the point of intersection of the cutting edge of the cutting tool 22 with the curved or arcuate surface 20 may be increased, as desired or required, to suit the correspondingly heavier and thicker resilient floor coverings which are greater than ⅛ inch and up to ¼ inch or even more.

The thicknesses of such spacing elements 26 will vary, depending upon the increased thickness of the resilient floor covering, its nature, its physical characteristics and surface properties. The usual range for the thicknesses of such spacing elements 26 is from about ⅛ inch to about ¼ inch. For simplicity purposes, the wall edge trimmer 10 may be used, as is, without spacers, for thicknesses of resilient floor coverings of ⅛ inch or less. For thicknesses which are greater than ⅛ inch and up to about ¼ inch, a single spacer having a thickness of about 3/16 inch may be supplied and used for such thicknesses. It is therefore a very simple matter for a person with practically no experience to simply determine the thickness of the resilient floor covering, which information is always readily available, and to use the wall edge trimmer, as is, or with the spacing element, depending on the thickness of the resilient floor covering.

It is noted that, if different spacing elements 26 are used as shown in FIG. 3, the cutting blade or tool 22 is adjustably moved into parallel planes laterally of itself and that it is always maintained at the same angle with respect to the plane containing the base surface 12, whereby the blade 22 always enters, cuts, and trims the resilient floor covering R at the same precise angle of entry thereinto. Under normal circumstances, the constant angular relationship between the plane containing the cutting blade 22 and the plane containing the base surface 12 is in the range of from about 33° to about 60°, as measured from the plane containing the base surface 12 in a counterclockwise direction to the plane containing the cutting blade or tool 22. Such angular relationship is best illustrated in FIGS. 1 and 3. It is, of course, also equal to the angle of the slope of the slot or opening between the two parts 11 and 13 of the wall edge trimmer 10. In FIG. 1, it is approximately 55.7° and in FIG. 3, it is approximately 43.7°.

If the plane containing the cutting blade or tool 22 were to pass directly through the central axis C of the quarter cylinder and then pass through the point B on the curved or arcuate surface 20. then the cut made in the resilient floor covering R would be perfectly perpendicular or at right angles to the top and bottom surfaces of the resilient floor covering R. As such, the cut would be very square and would presumably fit perfectly smoothly and snugly into the right angled corner formed by the vertical wall W and the horizontal floor F. Unfortunately, however, such corner often collects sawdust and other extraneous matter, if a newly built construction is involved, or it would accumulate dust, dirt and other exraneous matter, if an older construction is involved. As a result, the perfectly square edge of the resilient floor covering R does not fit perfectly square and snugly in the right angled corner where the wall W and the floor F meet. This, of course, is not desirable.

Therefore, the plane containing the cutting blade or tool 22 is rotated upwardly in a counterclockwise direction and passes vertically over and above the central axis C of the quarter cylinder but, since it still is passed through the curved or arcuate surface 20 at the same point, that is, one radian's length from the point A, the cut end on the resilient floor covering R is more or less slanted backwardly underneath and is undercut to some degree, whereby the bottom edge of the resilient floor covering R is positioned rearwardly of the top edge of the resilient floor covering R, thus providing a small crevice or space to accomodate any sawdust, dust, dirt or other extraneous matter which may have accumulated in the corner of the vertical wall W and the horizontal floor F. Such undercut condition will be hidden by the overhang of the top surface and will not be noticeable by persons standing on the resilient floor covering R.

The plane passing through the central axis C of the quarter cylinder and the point B on the curved or arcuate surface 20 is at an angle of 90° minus 57.3° or 32.7° to the plane containing the base surface 12. Rotation of the plane passing through the point B on the curved or arcuate surface 20 upwardly into a range of from about 33° to about 60° with respect to the plane containing the base surface 12 will create the desirable overhang. This is therefore also the angular range for the front sloping surface of the rear part 13 upon which the cutting blade or tool 22 will rest, as shown in FIG. 1, or be parallel to, as shown in FIG. 3.

A handle or knob (not shown) may be added to facilitate the gripping and handling of the wall edge trimmer 10, particularly when the wall edge trimmer 10 must be used under closet or drawer overhangs. The use of such a handle or knob is well known in the art and it may be attached to the top surface 14 or to the rear surface 16 and may be pivoted so that may be rotated from a depressed position to an elevated position, as desired or required.

THE PREFERRED EMBODIMENT OF FIG. 4

Figure 4:
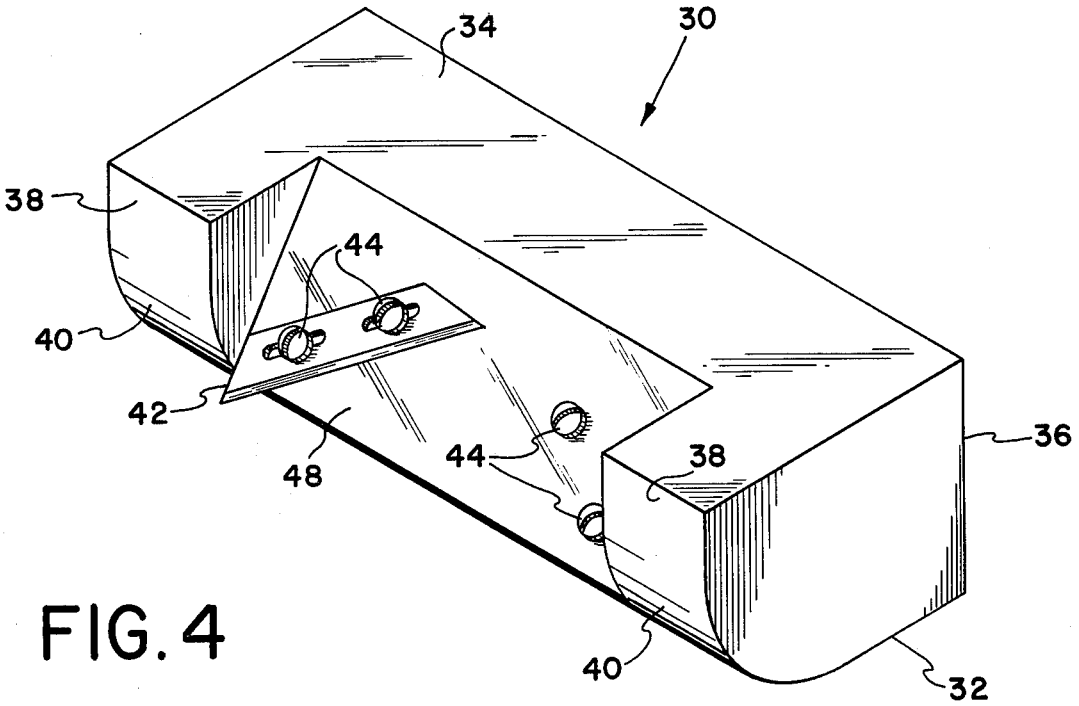
FIG. 4 is a simplified perspective view of another specific, preferred embodiment of the present invention, again shown in a very simple, basic form.

In FIG. 4, there is illustrated a modification of the wall edge trimmer 10 of FIGS. 1-3. In FIG. 4, a wall edge trimmer 30 is illustrated having a flat, horizontally planar, relatively smooth base surface 32, a unitary top or upper surface 34, a rear surface 36, a flat, vertically planar, relatively smooth front surface 38, and a unitary, relatively smooth, curved or arcuate surface 40 having the surface of a quarter cylinder which is formed by passing two planes at right angles to each other through the center or central axis of a right, regular cylinder. All these are very similar in nature, general shape and function or operation to correspondingly identified elements in FIGS. 1-3, with the exception that the wall edge trimmer 30 is an integral structure, whereas the wall edge trimmer 10 is in two parts.

A cutting blade or tool 42 is provided and is positioned by protruding positioning screws 44 so as to extend from within the body of the wall edge trimmer 30 to a point outside the periphery of the curved or arcuate surface 40. It is to be appreciated that the cutting blade or tool 42 is completely visible for its full length and is readily available for adjustment or for reversal, as desired or required.

Spacing elements (not shown) may be provided underneath the cutting blade or tool 42 so that it can be moved laterally and parallel to the sloping surface 48 of the wall edge trimmer 30. Thus, the blade 42 can be spaced, as desired, for different thicknesses of resilient floor coverings R, in very much the same fashion as previously described with reference to the wall edge trimmers of FIGS. 1 and 3. Again, it is to be observed that the cutting blade or tool 42 is adjustably moved parallel to itself into parallel planes in which the angular relationship of the cutting blade or tool 42 with respect to the base surface 32 is always maintained the same and is in the range of from about 33° to about 60°, the plane of the cutting blade or tool 42 passes vertically over and above the central axis of the quarter cylinder, whereby the overhang feature is attained.

Thus, it is seen that the basic principles involved in the use of the wall edge trimmer 30 of FIG. 4 are the same as those involved in the use of the wall edge trimmer 10 of FIGS. 1–3, except that the construction of FIG. 4 is integral and in one piece, whereas the construction of FIGS. 1–3 is not integral but is in two pieces.

The wall edge trimmers of the present invention may be made of wood, preferably a hardwood rather than a softwood, or synthetic thermoplastic or thermosetting plastic materials, or of metallic materials which may be desirably plated with nickel or chrome and be very smooth so that they will not scratch, mar, or mark the surface of the resilient floor coverings, or of any other suitable hard-surfaced material of construction.

The invention will be further illustrated in greater detail by the following specific examples. It should be understood, however, that, although these examples may describe in particular detail some of the more specific features of the present invention, they are set forth primarily for purposes of illustration and the present invention in its broader aspects is not to be construed as limited to the particular materials, constructions, or designs described therein.

EXAMPLE I

A wall edge trimmer, such as generally illustrated in FIGS. 1 and 2, is used for this example. The flat, horizontally planar, relatively smooth base surface is 1½ inches. The top surface is in two parts: the portion on the rear part of the wall edge trimmer is 2 inches long, and the portion on the front part of the wall edge trimmer is 1½ inches long. The total length of the top surface is 3½ inches. The flat, vertically planar, relatively smooth front surface is ⅝ inch. The radius of the curved or arcuate surface is 2 inches. It is the surface of a quarter cylinder of a right, regular cylinder. The curved or arcuate surface is relatively smooth. The length of the curved or arcuate surface on the rear part of the wall edge trimmer is a radian, or the length of its radius laid out on the peripheral surface. The central angle subtended by such an arcuate length is 57.3°. The plane containing the cutting blade or tool makes an angle of 55.7° with the plane which contains the base surface. The width of the wall edge trimmer is 4 inches. The wall edge trimmer is made of hardwood. The cutting blade or tool is a double-edged razor blade of a conventional make and is held in place by a pair of protruding positioning studs which pass through the openings in the double-edged razor blade and fit snugly into recessed openings in the underside of the front part of the wall edge trimmer.

The wall edge trimmer is used to cut and trim resilient floor coverings which have thicknesses of (Ia) 1/16 inch and (Ib) ⅛ inch. No spacing elements are used. Length AO is 2 inches; length AB is 2 inches as measured along the periphery of the curved or arcuate surface.

The wall edge trimmer performs perfectly and excellent wall-to-wall fitting is obtained without involving any guesswork or estimating. The cut edge of the resilient floor covering has an overhang which is sufficient to accomodate any reasonable amount of sawdust, dust or dirt, or other extraneous materials.

In initially starting the cut in the resilient floor covering, the cutting blade or tool is brought against the surface of the resilient floor covering in such a way and from a position slightly higher than the final sliding position, whereby the cutting blade enters the resilient floor covering at a point slightly higher than the final cut and trimmed line. However, the reverse cutting stroke in the opposite direction which is made with the razor blade in the opposite position cuts and removes the slight amount of the higher part of the resilient floor covering.

EXAMPLE II

The procedures of Example I are followed substantially as described therein and the wall edge trimmer is substantially the same, except that it is used to cut a resilient floor covering having a thickness of ¼ inch. A spacer is used, as shown in FIG. 3 and has a thickness of ¼ inch. The wall edge trimmer performs perfectly and excellent wall-to-wall conformity is obtained without involving any guesswork or estimating. The presence of a desirable overhang in the resilient floor covering is noted.

EXAMPLE III

The procedures described in Example I are followed substantially as described therein with the exception that a spacing element having a thickness of about 1/16 inch is used whereby the point of penetration of the cutting tool through the resilient floor covering is moved slightly to the left and slightly upwardly, as seen in FIG. 1. The fitting of the trimmed edge of the resilient floor covering with the wall is even superior to the fitting obtained in Example I which was excellent and commercially acceptable.

EXAMPLE IV

The procedures described in Example I are followed substantially as described therein with the exception that a spacing element having a thickness of about ⅛ inch is used whereby the point of penetration of the cutting tool through the resilient floor covering is moved even more to the left and even more upwardly, as seen in FIG. 1. The fitting of the trimmed edge of the resilient floor covering with the wall is even superior to the fitting obtained in Example I which was excellent and commercially acceptable.

EXAMPLE V

The procedures described in Examples I and I are followed substantially as described therein with the exception that a thicker cutting blade having a thickness of about 0.060 inch was used to replace the very thin double-edged razor blade used therein. The results obtained in this Example were found to be slightly better than the results of Examples I and I, in that the fitting seemed to be slightly better between the resilient floor covering and the wall.

EXAMPLE VI

The procedures of Example I are followed substantially as described therein and the wall edge trimmer is substantially the same, except that its dimensions are changed as follows: the top or upper rear surface is 2 inches; the top or upper front surface is 2⅛ inches; the vertical front surface is ⅝ inch; the radius of the curved or arcuate surface is 2¼ inches; the total height is 2⅞ inches; the cutting blade is very thin and measures 0.010 inch and is in a plane at 43.7° to the plane containing the base surface; the width of the wall edge trimmer is 4 inches; the total top surface is 4⅛ inches; and a pivoted handle is secured to the vertical rear surface to facilitate the use of the wall edge trimmer.

The wall edge trimmer is used to cut and trim resilient floor coverings having thicknesses of 1/16 inch and ⅛ inch. No spacers are used. The wall edge trimmer performs perfectly and perfect conformity and fitting is obtained in the wall-to-wall procedures. An overhang is again desirably obtained.

Although only a few examples have been set forth to illustrate the principles of the present invention in greater detail, the broader aspects of the present invention are not to be construed as limited thereto, except as defined by the attached claims.

What is claimed is:

1. A wall edge trimmer for resilient floor coverings comprising: a flat, horizontally planar, relatively smooth base surface capable of sliding along the surface of a resilient floor covering laid out on a floor; a flat, vertically planar, relatively smooth front surface lying in a plane substantially at right angles to the plane containing said flat, horizontally planar, relatively smooth base surface and capable of sliding along the surface of a portion of said resilient floor covering which is curled upwardly and contacts the lowermost portion of a wall; said flat, horizontally planar, relatively smooth base surface and said flat, vertically planar, relatively smooth front surface possessing sufficient flat, planar surfaces whereby said wall edge trimmer is capable of steady, stable, non-rocking sliding motion along the surface of said resilient floor covering; an upper or top surface; a rear surface connecting said upper or top surface and said flat, horizontally planar, relatively smooth base surface; a relatively smooth arcuate surface in the form of a quarter cylinder connecting said flat, horizontally planar, relatively smooth base surface and said flat, vertically planar, relatively smooth front surface; a cutting tool intersecting said arcuate surface and extending from a point within said wall edge trimmer to a point beyond said arcuate surface; and means capable of adjusting said cutting tool into parallel planes laterally of itself to always maintain said cutting tool at a constant angular relationship of from about 33° to about 60° with respect to the plane of said flat, horizontally planar, relatively smooth base surface, said flat, horizontally planar, relatively smooth base surface contacting said arcuate surface at a straight-line distance from the plane containing said flat, vertically planar, relatively smooth front surface equal to the arcuate distance from the point of intersection of said flat, horizontally planar, relatively smooth base surface and said arcuate surface to the point of intersection of said arcuate surface and said cutting tool, as measured along said arcuate surface, said straight-line distance and said arcuate distance both being equal in length to the radius of said quarter cylinder.

2. A wall edge trimmer as defined in claim 1, wherein the plane containing said cutting tool passes above the central axis of said quarter cylinder, whereby an undercut condition is obtained in the cut edge of the trimmed resilient floor covering.

3. A wall edge trimmer as defined in claim 1, wherein said means capable of adjusting said cutting tool into parallel planes laterally of itself comprise spacing elements.

4. A wall edge trimmer as defined in claim 1, wherein said means capable of adjusting said cutting tool into parallel planes laterally of itself comprise annular washers.

* * * * *